US008087931B2

(12) United States Patent
Erhard

(10) Patent No.: US 8,087,931 B2
(45) Date of Patent: Jan. 3, 2012

(54) DEVICE FOR SUPPORTING ARTICLES TO BE FIRED THAT HAS A DEFINED COMPENSATION OF THERMAL EXPANSIONS

(75) Inventor: Winkler Erhard, Rödental (DE)

(73) Assignee: Saint Gobain IndustrieKeramik Rodental, GmbH, Rodental (DE)

( * ) Notice: Subject to any disclaimer, the term of this patent is extended or adjusted under 35 U.S.C. 154(b) by 318 days.

(21) Appl. No.: 11/814,784

(22) PCT Filed: Jan. 25, 2006

(86) PCT No.: PCT/EP2006/000639

§ 371 (c)(1),
(2), (4) Date: Nov. 6, 2007

(87) PCT Pub. No.: WO2006/079518

PCT Pub. Date: Aug. 3, 2006

(65) Prior Publication Data

US 2008/0138754 A1 Jun. 12, 2008

(30) Foreign Application Priority Data

Jan. 25, 2005 (DE) ..... 10 2005 003 501

(51) Int. Cl.
*F27D 5/00* (2006.01)

(52) U.S. Cl. ..... 432/258; 432/253; 432/259; 432/261; 211/41.17; 211/41.18; 211/70.3; 211/162

(58) Field of Classification Search ..... 432/253, 432/258, 259, 261; 211/41.17, 41.18, 70.3, 211/162, 189, 191

See application file for complete search history.

(56) References Cited

U.S. PATENT DOCUMENTS

| | | | | |
|---|---|---|---|---|
| 2,434,852 | A * | 1/1948 | Jackson | 432/261 |
| 3,739,921 | A * | 6/1973 | Schmidt | 211/194 |
| 5,785,519 | A * | 7/1998 | Becker et al. | 432/258 |
| 6,917,755 | B2 * | 7/2005 | Nguyen et al. | 392/418 |
| 2003/0074849 | A1 * | 4/2003 | Surowiecki | 52/301 |

FOREIGN PATENT DOCUMENTS

| | | | |
|---|---|---|---|
| DE | 2040024 | | 2/1972 |
| DE | 19833880 | | 2/2000 |
| DE | 10143996 | | 6/2003 |
| DE | 2853960 | * | 7/2003 |

(Continued)

OTHER PUBLICATIONS

International Search Report (including translation) for Intenational (PCT) Patent Application No. PCT/EP2006/000639, mailed Jun. 1, 2006.

(Continued)

*Primary Examiner* — Steven B McAllister
*Assistant Examiner* — Seth Greenia
(74) *Attorney, Agent, or Firm* — Sheridan Ross, P.C.

(57) ABSTRACT

The present invention relates to a device for supporting, stacking, and transporting kiln run, in particular for firing ceramic products, comprising an assembly of supports and support beams, like carrier beams and cross beams, on which, in particular one or several supports for placing the kiln run are provided. Thus, for supporting at least one support beam, at least one loose bearing is provided, comprising a support body, moveably disposed, substantially in the direction of the support beam.

9 Claims, 3 Drawing Sheets

FOREIGN PATENT DOCUMENTS

| | | | |
|---|---|---|---|
| DE | 20305182 | | 7/2003 |
| EP | 0908690 | | 4/1999 |
| FR | 2853960 | * | 10/2004 |
| HU | 2837 | | 11/2004 |
| JP | 56-31298 | | 3/1981 |
| JP | 4-106498 | | 9/1992 |
| JP | 10-503581 | | 3/1998 |
| JP | 10-311686 | | 11/1998 |
| JP | 2004-263919 | | 9/2004 |

OTHER PUBLICATIONS

Written Opinion (including translation) for Intenational (PCT) Patent Application No. PCT/EP2006/000639, mailed Jun. 1, 2006.

International Preliminary Report on Patentability (including translation) for Intenational (PCT) Patent Application No. PCT/EP2006/000639, issued Jul. 31, 2007.

* cited by examiner

DEVICE FOR SUPPORTING ARTICLES TO BE FIRED THAT HAS A DEFINED COMPENSATION OF THERMAL EXPANSIONS

CROSS REFERENCE TO RELATED APPLICATION

This application is a national stage application under 35 U.S.C. 371 of PCT Application No. PCT/EP2006/000639 having an international filing date of Jan. 25, 2006, which designated the United States, which PCT application claimed the benefit of German Application Serial No. 102005003501.9, filed Jan. 25, 2005, the entire disclosure of each of which is hereby incorporated herein by reference.

FIELD OF THE INVENTION

The present invention relates to a device for supporting, stacking, and transporting kiln run, in particular for firing ceramic products.

BACKGROUND OF THE INVENTION

In order to be able to manufacture ceramic products, they have to be fired in a kiln. For importing and exporting from the oven, these ceramic products are preferably supported on a device, which can be moved into the oven and removed again. In the state of the art, respective kiln carts are known for this purpose, comprising fire resistant superstructures (kiln cart superstructures) made form support assemblies, in which respective holders or support systems for ceramic products or the kiln run in general are formed from several supports and support carriers, like carrier beams, cross beams, large plates or similar.

According to a known embodiment, the supports are provided with window openings, in which carrier beams can be received. Typically the supports are provided as rectangular tubes, so that the window openings are provided in two opposite side walls of the rectangular tubes. When inserting a carrier beam, which is typically also provided as a rectangular tube, thus two support locations of the carrier beam are created in the support, thus in one respective side wall. This leads to the disadvantage that, in case of imprecisions or deformations of the supports, or carrier beams, no equal load is created in the supports, but the carrier beam possibly only rests in one side wall, and in the extreme, even punctiform contact locations are created. This leads to a one-sided loading of the support with the respective induction of moments, which are problematic, in particular, with the typically used material for supports, carrier beams, etc., which has to be suitable for the high firing temperatures of the ceramic kiln run. Typically ceramic materials, e.g. $Al_2O_3$, RSiC, SiSiC, NSiC or Mullite, are used for the superstructure of the kin cart, which are known to be sensitive with respect to tension—and/or bending loads.

It is disadvantageous, in particular that, in case of horizontally non aligned window openings and carrier beams, punctiform contact locations are created in the side walls, which creates the risk of chipping off ceramic material from the supports and carrier beams. Through elastic bending of the carrier beams, when they are loaded with ceramic kiln run, the stress peaks at the support locations of the carrier beams on the side walls are even increased.

An additional reinforcement of the load peaks can also be created by the fact that at the typical firing temperatures of over 1000° C., due to the thermal expansion of the materials, motions between the particular components of the support arrangements, thus also between the carrier beams and the supports, inevitably occur. Due to the surface support of the carrier beams on two supports in the side walls, large amounts of friction occur between the carrier beam and the support. Due to this large amount of friction, the thermal expansion of the carrier beams cannot be relieved in a defined manner, whereby the transfer of high lateral forces becomes possible.

Various methods were suggested, in order to eliminate these disadvantages. E.g. through the insertion of carrier plates into the window openings, wherein the carrier plates can also be provided cylindrical or convex, defined contact areas between the side walls and the carrier beams shall be assured. Furthermore, in case of a possible tipping of the carrier beams, chipping on the side walls of the window openings shall be avoided. The Patent document DE 203 05 182 U1 provides e.g. to support the carrier beams on differently shaped support bodies, which are mounted in the support, perpendicular to the window openings. These support bodies are thereby inserted into the support, or tied to the support, loosely but precisely fitting. Thereby, the high amount of friction of a line shaped support between carrier beam and support body is maintained, and the thermal expansion between carrier beams and supports during heating and cooling cannot be relieved in a defined manner.

Thus it is the object of the present invention to provide a device for holding and supporting or stacking and transporting kiln run, in particular, kiln run for firing ceramic products, which avoids the advantages of the above described state of the art. In particular, a device shall be provided, which relieves thermal expansions of the carrier beams in a defined and reliable manner. This relief shall also occur, when heavy ceramic products, e.g. washbowls and toilets, are supported on the device. Furthermore, this device shall be simple to manufacture.

SUMMARY OF THE INVENTION

The object is accomplished according to the invention through a device with the features of Patent claim 1, wherein advantageous embodiments of the device are objects of the dependent claims.

The device according to the invention for supporting, stacking, and transporting kiln run, in particular for firing ceramic products, comprises an assembly of supports and support beams, received at the supports, in particular, carrier beams, cross beams, large plates, or similar, on which, in particular, one or several supports for placing the kiln run are provided. For supporting at least one support carrier, at least one loose bearing is provided, comprising a support body, which is moveably disposed, substantially in the direction of the support carrier. The directional reference to the support carrier always refers to the lateral longitudinal extension of this element.

The invention is based on the finding that the high static friction e.g. between carrier beam and support is the reason that a relief of thermal expansion of the carrier beam can be blocked completely. According to the invention, the high static friction is replaced by significantly smaller roll friction and eliminated between the carrier beam and the cross beam or similar, and the support body, on the one hand, and the support body and the receiver of the support body, on the other hand. Through a loose bearing, which avoids static and dynamic friction, the defined and reliable relief of the thermal expansion of the support beam is assured, so that peak stresses and the risk of chipping ceramic material of the kiln cart superstructure can be avoided.

In a preferred embodiment, the loose bearing is provided as a bearing of a carrier beam, which is received in window openings by two supports. Thus, the support body of the loose bearing of the carrier beam is inserted, substantially in the window opening of a support, and perpendicular to the direction of the window opening, and to the carrier beam, in a guide formed by two parallel slotted holes, extending substantially parallel to the carrier beam in the outside of the support. This way, the loose bearing of the carrier beam can be integrated very easily into the support preferably provided as a rectangular tube, and several loose bearings can easily be housed in one support.

Through the support body, the load of the carrier beam, and possibly of additional support beams and of the kiln run is transferred to the side walls of the support, whereby tension can build up. Now, when the window opening of the support for passing through the carrier beam is preferably provided at the bottom and/or at the top with round corners and/or with an arc, in particular, as a semicircle, the compression stress distribution in the support is improved, since stress concentration through notch effects is avoided in the corners of the window opening.

In another preferred embodiment, the loose bearing is provided as a bearing of a cross beam or of a large plate, which are received on two carrier beams. Thereby, the support body of the loose bearing of the lateral beam, or of the large plate loosely rests on the upper surface of a carrier beam, and the upper side is provided with at least one lateral side stop for the support body. Thus the support of this support carrier is integrated in the kiln cart superstructure in a particularly advantageous manner. The fixed bearing of this support carrier can thereby be configured, so that a substantially linear support, or a support with a support area is created, assuring a high amount of static friction. However, also other fixation measures and suitable design fixations are possible.

The upper side of the carrier beam, on which the loose bearing of the cross beam or of the large plate is provided, is provided continuously flat in transversal direction. Additionally, the upper side can also have one or several transversally extending depressions. On them or in them, the support body of the loose bearing can run, wherein its position on the carrier beam is fixed. Furthermore, thus the support surface of the support body on the carrier beam can be reduced, and only roll friction is effective.

According to a preferred embodiment, the loose bearing is tilted relative to the horizontal direction, thus it has a vertical rise. This way, the support body is disposed in front of the support carrier in a vertically lower position, compensating for an expansion of the support carrier during the heating through rolling into a vertically higher position. After the removal of the support carrier from the loose bearing, or contraction due to cooling, the support body independently rolls into the lower position. Thereby, it is assured that the loose bearing always takes such a base position in cooled state, which allows a motion compensating for thermal expansion. Alternatively, the transversal beam for the loose bearing can also be provided prismatic, thus shaped like a roof, and provided with lateral stop edges, and can comprise a loose rolling support body. This way, the loose bearing can compensate for thermal expansions towards two sides.

In order to secure the support body against the risk of sliding out of the slotted hole guide, the support body can have smaller pinions on two face sides or, alternatively, dumbbell shaped reinforcements, thus e.g. discs with a larger diameter than the central part of the support body. But also other kinds of lateral guides are possible. For example, the pinions or dumbbell shaped reinforcement can engage with the transversally extending depressions of the upper side of the carrier beam.

Subsequently, an embodiment of a device for supporting, stacking, and transporting of kiln run is described with reference to the schematic drawing. It is shown in:

DETAILED DESCRIPTION

Figure 1:
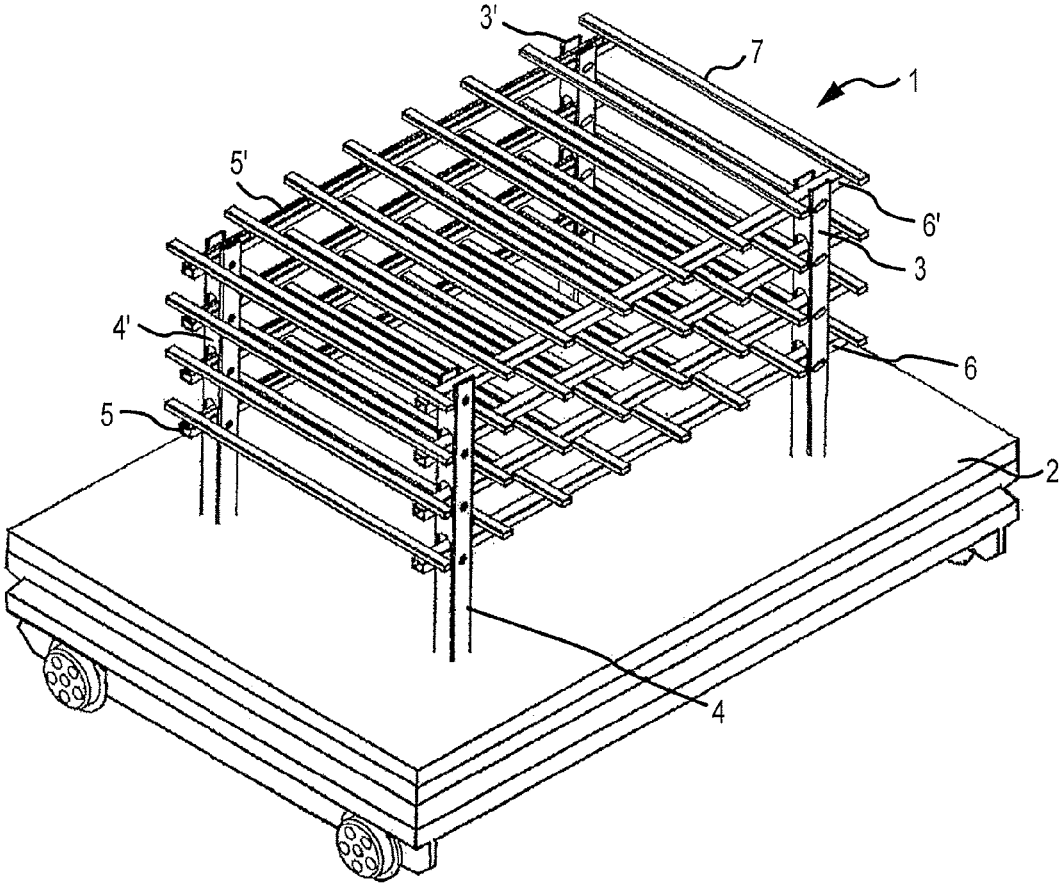
FIG. 1 a perspective view of the device, according to the invention, mounted on a kiln cart.

FIG. 1 shows a strictly schematic illustration of an embodiment of the device according to the invention for stacking and transporting kiln run 1, mounted onto a kiln cart 2 of a known type. This device 1 according to the invention comprises four vertical supports 3, 3', 4, 4' disposed in a rectangular pattern two each of them 3, 4 and 3', 4' receiving and supporting a row of carrier beams 5, 5', 6, 6'. The particular carrier beams 5, 6, 5', 6' of the support pairs 3, 4 and 3', 4' are thus disposed in parallel horizontal planes. On the pairs of carrier beams 5, 6 and 5', 6' thus opposed, again a row of cross beams 7 is disposed, extending perpendicular to the carrier beams 5, 5', 6, 6' and the supports 3, 3', 4, 4'. On the device 1, according to the invention, kiln run, in particular, ceramic kiln run can be supported and stacked and transported through the oven cart 2. Such oven carts 2 allow an easy input and output of kiln run into and from the kiln, wherein these processes can also be automated with such a kiln cart. Furthermore, it is also possible, to place large plates on the carrier beams 5, 5', 6, 6', on which the kiln run can be supported, stacked, and transported.

Figure 2:
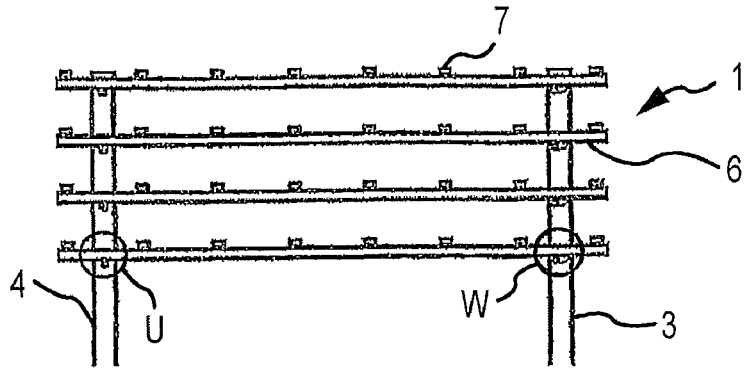
FIG. 2 a lateral view of the device according to the invention.
Figure 3:
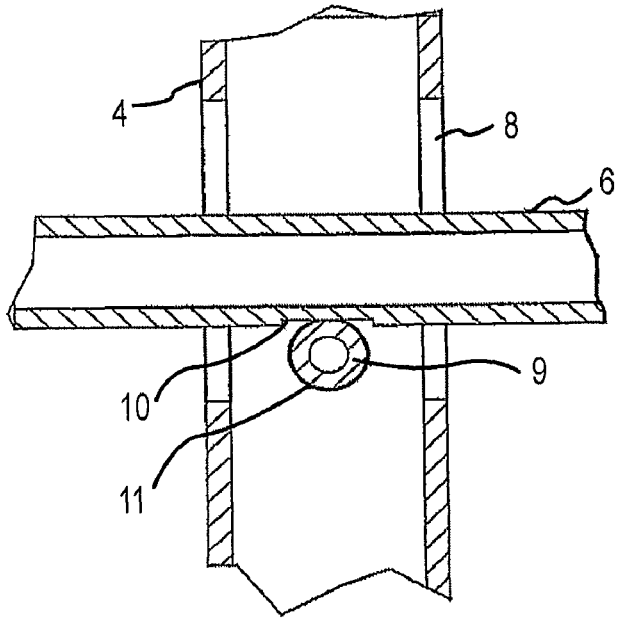
FIG. 3 a sectional view of a carrier beam according to the invention, supported in a rigid manner.
Figure 4:
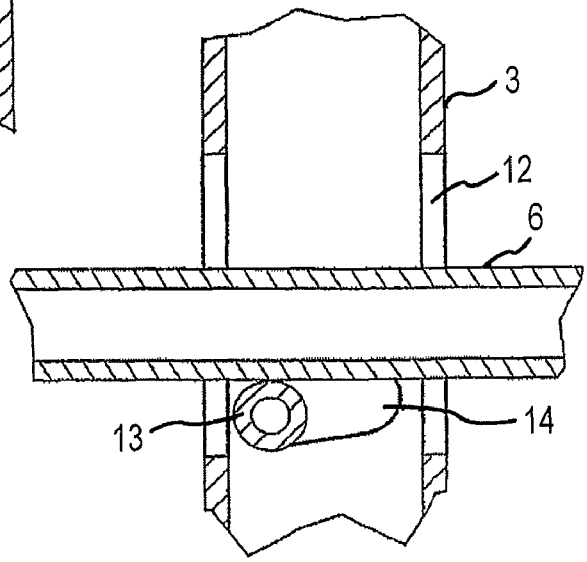
FIG. 4 a sectional view of a carrier beam, according to the invention, supported in a loose manner.

FIG. 2 shows the device 1 according to the invention, in a sectional view through the receivers of the carrier beams 6 in the supports 3, 4. These receivers are provided differently, and they are subsequently described in more detail with reference to FIGS. 3 and 4, which show the respective details U, W, in an enlarged manner. In particular, FIG. 3 shows a fixed bearing for a carrier beam 6, and FIG. 4 shows a loose bearing for a carrier beam 6. The fixed bearing is formed in a window opening 8 of the support 4 and comprises a support body 9, on which the carrier beam 6 rests with an indentation 10. The carrier beam 6 tangentially rests on the support body 9 with the inner surface of the indentation 10, so that a linear support is created. The support body 9 is disposed in a plane perpendicular to the direction of the window opening 8 in the support 4, and received in one opening 11 each, in the side walls of the support 4. The window opening 8 and the support body 9 are thus disposed and sized relative to each other, depending on the size of the carrier beam 6, so that the carrier beam 6 does not touch the upper and lower corners of the window opening 8. The side edges of the indentation 10 limit a sliding of the carrier beam 6 relative to the support body 9, and thus fixate the carrier beam 6 on the support body 9 in a fixed bearing. This works even more safely, when the carrier beam is loaded with the weight of the kiln run. Thus the support body 9 can be disposed in the openings 11 in a rotatable or fixed manner.

The loose bearing of the carrier beam 6 shown in FIG. 4 is disposed in a window opening 12 in the support 3, and comprises a support body 13, on which the support beam 6 rests. The support body 13 of the loose bearing is received in two slotted holes 14 in the illustrated embodiment, which extend parallel to each other in the side surfaces of the support 3, and inclined relative to horizontal, thus with a vertical rise. The diameter of the support body 13 is selected relative to the opening of the slotted hole 14, so that the support body 13 can easily roll independently from an elevated position, not shown in FIG. 4, into the illustrated lower position. The support body 13 and the window opening 12 are thus disposed and sized relative to each other, depending on the size of the carrier beam 6, so that the carrier beam 6 does not touch the upper and lower edges of the window opening 12.

The carrier beam 6 is supported as shown in FIG. 2, so that the slotted hole guide 14 of the support body 13 is inclined downward in the direction of the fixed bearing. In case of a temperature related longitudinal expansion of the carrier beam 6, it can expand starting from the fixed bearing in the direction of the loose bearing and beyond. Thereby, the carrier beam 6 is guided in a rolling motion through the linear support surface on the support body 13, wherein the support body 13 is rolled in the slotted hole guide 14 from a vertically lower position into a vertically higher position. The horizontal inclination of the slotted hole guide 14 is thereby adjusted, so that the carrier beam 6 is only raised by a couple of millimeters, and thus a sliding of the kiln run is avoided. In case the carrier beam 6 contracts again due to cooling, or the carrier beam 6 is lifted off the loose bearing of the support 3, the support body 13 rolls in the slotted hole guide 14 into a lower position again, and the loose bearing can compensate for another thermal expansion of the carrier beam 6.

The support beams, in particular, the carrier beam 6, are each preferably supported through a fixed and a loose bearing. The length of the loose bearing is to be selected depending on the thermal expansion coefficient of the ceramic material, the length of the carrier beam, and the temperature range of the kiln. When larger thermal expansions have to be compensated for, or in case of a short length of the loose bearing, e.g. due to a small width of the support, a large vertical rise of the support carrier has to be dealt with, thus the support carrier can also be placed onto two loose bearings. Thereby, the necessary vertical rises would be cut in half, and the support beam would substantially always stay horizontal.

Figure 5:
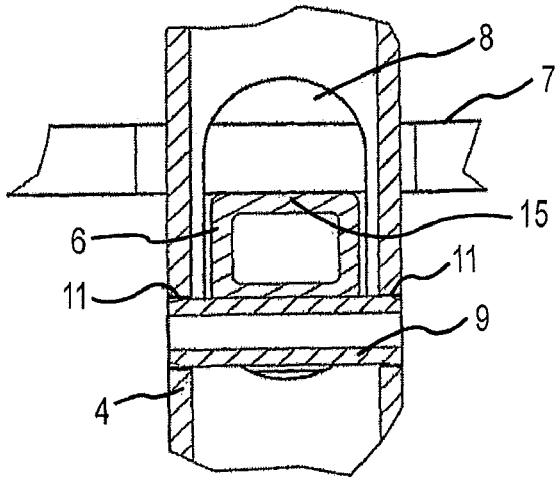
FIG. 5 a sectional view of a carrier beam according to the invention, supported in a rigid manner in a plane, perpendicular to FIG. 3, with a cross beam supported thereon in a rigid manner.

FIG. 5 shows a fixed bearing of a cross beam 7 in connection with a loose bearing of a carrier beam 6 in a sectional view through the fixed bearing of the carrier beam 6, according to FIG. 2. The window opening 8 of the support 4 is thereby provided with semicircular upper and lower edges, in order to accomplish a better pressure distribution within the support 4. The carrier beam 6 rests on the support body 9, which is disposed in openings 11. The carrier beam 6 is provided with rounded corners, and reaches through the window opening 8 without touching the side walls of the window opening 8. Thus damages to the material, in particular, wear at the support 4 and at the carrier beam 6 can be reliably avoided. The upper side 15 of the carrier beam 6 forms a surface support of the cross beam 7 through its flat design. Due to the large surface of the support of the cross beam 7 on the carrier beam 6 and the friction between both beams 6, 7, the support forms a fixed bearing for the cross beam 7. Certainly, the lateral beam 7 could also be fixated to the carrier beam 6 through design measures.

Figure 6:
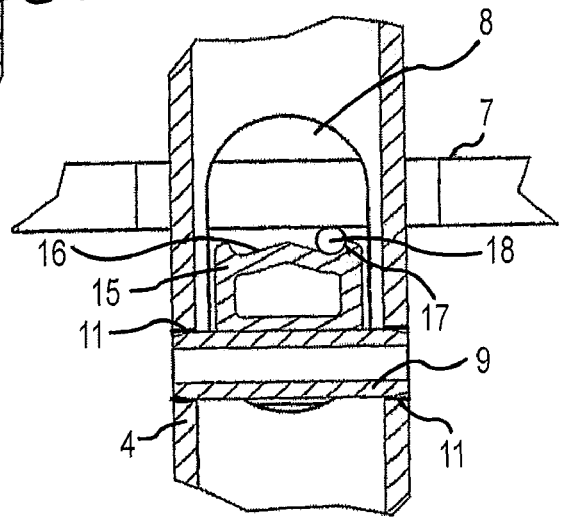
FIG. 6 a sectional view of a carrier beam, according to the present invention, supported in a rigid manner, in a plane, perpendicular to FIG. 3, with a cross beam supported thereon in a loose manner.

FIG. 6 shows a loose bearing of a cross beam 7, which is disposed on a carrier beam 5 with a fixed bearing. Thus the carrier beam 5 has an upper side 16, which is provided laterally raised in the middle like a roof and dropping to the sides, thus prismatic. On both sides of the carrier beam 5, laterally extending stop edges 17 are provided, laterally limiting the transversal motion of a support body 18, relative to the upper side 16 of the carrier beam 5. The length of the support body 18 corresponds approximately to the width of the cross beam 7. The support body 18 can move freely on the prismatic upper side 16 between the stop edges 17. The lateral beam 7 is thereby supported with a linear support on the support body 18, and can compensate thermal expansions through rolling motion over the support body 18. Also here, like in the loose bearing of the support beam 6, shown in FIG. 4, a horizontal inclination in the guide 16 of the support body 18 is provided, so that the support body 18 returns to its initial position at a stop edge 17, due to gravity. Thereby, it is assured that the loose bearing of the lateral beam 7 can compensate for a thermal expansion of the lateral beam 7 any time.

In order to avoid a bending of particularly large carrier beams in the support assembly between two supports, an additional support can be provided, which is provided in alignment with them, comprising respective fixed and loose bearings, or only loose bearings or fixed bearings. This way, chain assemblies with laterally sequentially disposed carrier beams are possible, whereby e.g. the disadvantages (canting, imprecision of support, etc.) of carrier beams, which are supported on three supports, are avoided. With the same method, certainly also long lateral beams can be replaced by lateral beams located behind each other, each resting on a outer carrier beam and a common middle carrier beam, resting between two outer carrier beams.

The prismatic loose bearing for cross beams 7 shown in FIG. 6, is adapted for thermal expansion motions of two beams 7, disposed in series, through the guide of the support body 18, which is horizontally inclined on both sides. Thus this loose bearing can be advantageously disposed between two fixed bearings, and can form a support compensating for thermal expansions for cross beams 7 of the one fixed bearing, and of the other fixed bearing. Certainly it is also possible to provide the loose bearing with a support body 18, which is supported so it can roll on a continuously inclined plane, disposed between two stop edges 17, so that the loose bearing can be used for thermal expansion compensation in one direction.

Figure 7:
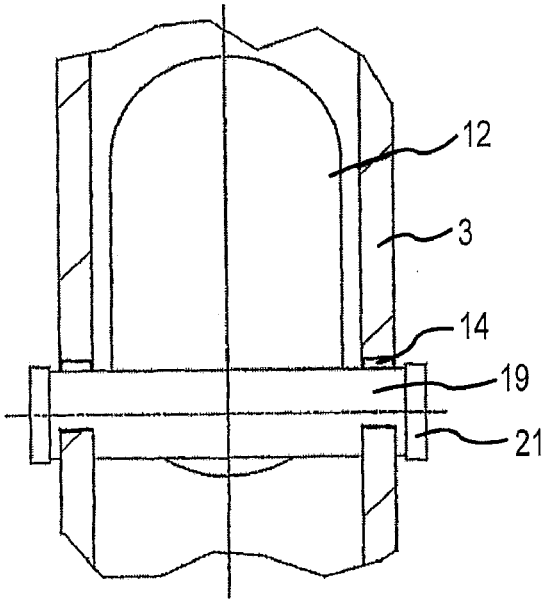
FIG. 7 a sectional view of a first embodiment of a loose bearing for carrier beams according to the present invention.
Figure 8:
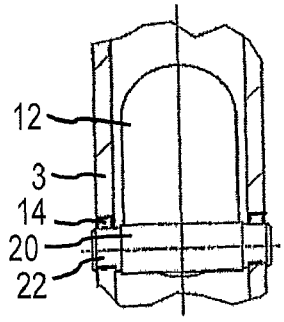
FIG. 8 a sectional view through a second embodiment of a loose bearing for carrier beams according to the present invention.

FIGS. 7 and 8 show two embodiments of the loose bearing for carrier beams 5, 5', 6, 6' with a different design of the guide of two support bodies 19, 20 in the slotted hole guide 14. In particular, the support 3 is shown with the window opening 12 for receiving the carrier beams 5, 5', 6, 6' (not shown), and the slotted hole guide 14, wherein the support body 19 in FIG. 7 has a cylindrical shape, at whose front faces two dumbbell shaped reinforcements 21 are disposed. The dumbbell reinforcements 21 of the support body 19 thus have a diameter, which is slightly smaller than the cross section of the slotted hole guide 14, so that the support body 19 can be inserted into the slotted hole guide 14. As shown in FIG. 7, the support body 19 rests on the lower edge of the slotted hole guide 14, and the dumbbell shaped reinforcement 21 reaches behind the slotted hole guide 14 on the outside, without the dumbbell shaped reinforcement 21 and the slotted hole guide 14 touching each other. Thereby, friction losses are minimized, while the support body 19 is still secured against sliding out of the slotted support guide 14. The ends of the dumbbells can also be extended and can receive the cutout carrier beam on the outside. Thereby, the cutout in the support can be omitted. FIG. 8 also shows a friction minimized and secured guide of the support body 20 in the slotted hole guide 14. Hereby, the cylinder shaped support body 20 is laterally provided with two pinions 22 with a smaller diameter, whereby the support body 20 reaches behind the slotted hole guide 14 on the inside. The diameter of the cylinder shaped part of the support body 20 is thus slightly smaller than the cross section of the slotted hole guide 14, so that the support body 20 has to be inserted into the slotted hole guide 14.

The supports 3, 3', 4, 4' and the carrier beams 5, 5', 6, 6' are provided as hollow rectangular tubes, the support bodies 9, 13, 19, 20 are provided as hollow round tubes, or solid round bars, the cross beams 7 are provided as solid rectangular bars or as hollow profiles, and the support body 18 is provided as a solid round bar. In order to increase stability, it is also possible, in particular, to provide the supports 3, 3', 4, 4', the carrier beams 5, 5', 6, 6', and the support bodies 9, 13, 19, 20 solid, and to provide the lateral beams 7 and the support bodies 18 hollow, in particular, for reducing the weight of the device 1. Though the support bodies 9, 13, 19, 20, described herein, are provided substantially cylindrical, certainly any other shape, e.g. spherical, which allows a rolling motion of the supports beams 5, 5', 6, 6', 7, is useable.

The support bodies 9, 13, 19, 20 and the supports 3, 3', 4, 4' and the support beams 5, 5', 6, 6', 7 can be made from any ceramic material with sufficient fire resistance, and mechanical strength, as e.g. $Al_2O_3$, RSiC, SiSiC, NSiC or Mullite, and other suitable materials combinations. Preferably the support bodies 9, 13, 19, 20 are made from an inert ceramic material, relative to the carrier beam 5, 5', 6, 6', and the support 3, 3', 4, 4', and the cross beam 7, so that a bonding of the supports 3, 3', 4, 4', and the carrier beams 5, 5', 6, 6', 7 with the support bodies 9, 13, 19, 20, as it is possible e.g. in a direct contact of identical ceramic materials through surface oxidation, glazing condensation, or sintering, is effectively avoided.

What is claimed is:

1. A device for supporting, stacking, and transporting kiln run, for firing ceramic products, comprising:

an assembly of support columns; a plurality of support beams received in window openings formed in the supports, said window openings having upper and lower bounds; at least one loose bearing for supporting at least one support beam, said loose bearing comprising a first support body that is moveably disposed in two slotted hole guides formed in said support columns, and said slotted hole guides having an incline and being aligned with the window openings and within the upper and lower bounds of the window openings.

2. A device according to claim 1, wherein at least one support beam is received by two respective supports within the upper and lower bounds of the respective window openings and is inserted into respective window openings in a direction perpendicular to a direction of the window openings; and said parallel slotted holes extend substantially parallel to the support beam.

3. A device according to claim 2, wherein the window openings have bottom or top bounds with round corners, or are shaped as an arc, or are shaped as a semicircular arc.

4. A device according to claim 1, wherein at least one cross beam is provided on two support beams; and at least one second support body is positioned in a loose manner between said support beam and said cross beam, and an upper side of said support beam is provided with at least one lateral side stop edge for the second support body.

5. A device according to claim 4, wherein the upper side of the support beam has at least one continuous transversal indentation.

6. A device according to claim 1, wherein the first support body has dumbbell shaped reinforcements or smaller pinions at two face sides.

7. A device for supporting, stacking, and transporting kiln run, for firing ceramic products, comprising:

an assembly of support columns; a plurality of support beams received at the supports;

at least one loose bearing for supporting at least one support beam, said loose bearing comprising a first support body moveably disposed in two inclined slotted hole guides formed in said support columns substantially in the direction of the support beam; and at least one second support body positioned in a loose manner between said support beam and said cross beam; and an upper side of said support beam is provided with at least one lateral side stop edge for the second support body.

8. A device according to claim 7, wherein the upper side of the support beam has at least one continuous transversal indentation.

9. A device for supporting, stacking, and transporting kiln run, for firing ceramic products, comprising:

an assembly of support columns; a plurality of support beams received at the supports;

at least one loose bearing for supporting at least one support beam, said loose bearing comprising a support body moveably disposed in two inclined slotted hole guides formed in said support columns; substantially in the direction of the support beam;

wherein the support body has dumbbell shaped reinforcements or smaller pinions at two face sides.

* * * * *